US005363830A

United States Patent [19]

Morikawa

[11] Patent Number: 5,363,830

[45] Date of Patent: Nov. 15, 1994

[54] AIR-FUEL RATIO CONTROLLER OF INTERNAL-COMBUSTION ENGINE

[75] Inventor: Junya Morikawa, Kasugai, Japan

[73] Assignee: Nippondenso Co., Ltd., Kariya, Japan

[21] Appl. No.: 145,856

[22] Filed: Nov. 5, 1993

[30] Foreign Application Priority Data

Nov. 10, 1992 [JP] Japan ..... 4-299926

[51] Int. Cl.[5] ..... F02M 25/08; F02D 41/14

[52] U.S. Cl. ..... 123/674; 123/698

[58] Field of Search ..... 123/674, 698, 519, 520

[56] References Cited

U.S. PATENT DOCUMENTS

| | | | |
|---|---|---|---|
| 4,677,956 | 7/1987 | Hamburg | 123/698 X |
| 4,748,959 | 6/1988 | Cook et al. | 123/698 X |
| 5,048,492 | 9/1991 | Davenport et al. | 123/674 |
| 5,048,493 | 9/1991 | Orzel et al. | 123/674 |
| 5,070,847 | 12/1991 | Akiyama et al. | 123/674 |
| 5,090,388 | 2/1992 | Hamburg et al. | 123/674 |
| 5,150,686 | 9/1992 | Okawa et al. | 123/698 |
| 5,216,997 | 7/1993 | Osanai et al. | 123/698 |
| 5,245,978 | 9/1993 | Orzel | 123/674 |
| 5,257,613 | 11/1993 | Monda et al. | 123/674 |

FOREIGN PATENT DOCUMENTS 2130240 5/1990 Japan .

*Primary Examiner*—Willis R. Wolfe, Jr.

*Attorney, Agent, or Firm*—Cushman, Darby & Cushman

[57] ABSTRACT

An air-fuel ratio controller of an internal combustion engine for preventing that an air-fuel ratio in the beginning of the purging operation of evaporated fuel is excessive. Evaporated fuel produced within a fuel tank is absorbed in a canister and the evaporated fuel absorbed in the canister is purged to the air intake side of the internal combustion engine through a purge valve together with air. A concentration of the evaporated fuel is detected by an air-fuel ratio feedback value detected by an oxygen sensor and a fuel injection quantity is corrected to be reduced in accordance with the detected evaporated fuel concentration and the purge ratio. When the air-fuel ratio feedback value exceeds a predetermined value or an output of the oxygen sensor is rich during the purging operation, it is judged that detection of concentration is insufficient and the update value for detection of concentration is made larger than a usual value. At the same time, gradual change of purging in the beginning of the purging is stopped to maintain or reduce the purge ratio.

3 Claims, 8 Drawing Sheets

AIR-FUEL RATIO CONTROLLER OF INTERNAL-COMBUSTION ENGINE

BACKGROUND OF THE INVENTION

The present invention relates to an air-fuel ratio controller of an internal-combustion engine for causing evaporated fuel produced within a fuel tank to be sucked into an air intake side of the internal-combustion engine and be burned.

As a conventional controller which stores evaporated fuel produced within a fuel tank in a canister and discharges the evaporated fuel stored in the canister into an air intake side of an internal-combustion engine to burn it, there is a controller which changes a purge amount of the canister by a predetermined value and detects a concentration of the evaporated fuel sucked into the air intake side of the internal-combustion engine from the canister on the basis of a variation of a feedback amount of an air-fuel ratio at this time to correct a learning value of the air-fuel ratio in accordance with the concentration (for example, JPA-2-130240).

The conventional controller described above has a problem that the air-fuel ratio tends to be excessive in the beginning of the purging since the concentration of the evaporated fuel is high in the beginning of the purging and is not detected exactly yet. U.S. Ser. No. 08/052,926 filed on Apr. 27, 1993, now U.S. Pat. No. 5,299,546, and U.S. Ser. No. 08/079,807 filed on Jun. 22, 1993, still pending, were entitled "air-fuel ratio control apparatus for internal combustion engine" and assigned to the present assignee.

SUMMARY OF THE INVENTION

It is an object of the present invention to suppress an excessive air-fuel ratio in the beginning of the purging.

According to the present invention, the concentration of the evaporated fuel is detected by the concentration detection means on the basis of the feedback value of the air-fuel ratio by the air-fuel ratio feedback means and the fuel amount is corrected by the purge responsive fuel amount correction means so that the air-fuel ratio is equal to a predetermined value in accordance with the concentration of the evaporated fuel detected by the concentration detection means and the purge ratio by the purge ratio control means. When it is judged that the air-fuel ratio is excessive on the basis of at least one of the output of the air-fuel ratio detection means and the feedback value of the air-fuel ratio during the purging operation by the flow rate control valve, the update amount of the concentration of the concentration detection means is increased by the air-fuel ratio responsive concentration updating means as compared with the usual amount.

Furthermore, when it is detected that the air-fuel ratio is excessive on the basis of at least one of the output of the air-fuel ratio detection means and the feedback value of the air-flow ratio during the purging operation by the flow rate control valve, increase of the purge ratio by the flow rate control valve can be suppressed by the air-fuel ratio responsive purge ratio suppressing means.

DESCRIPTION OF THE PREFERRED EMBODIMENT

Figure 1:
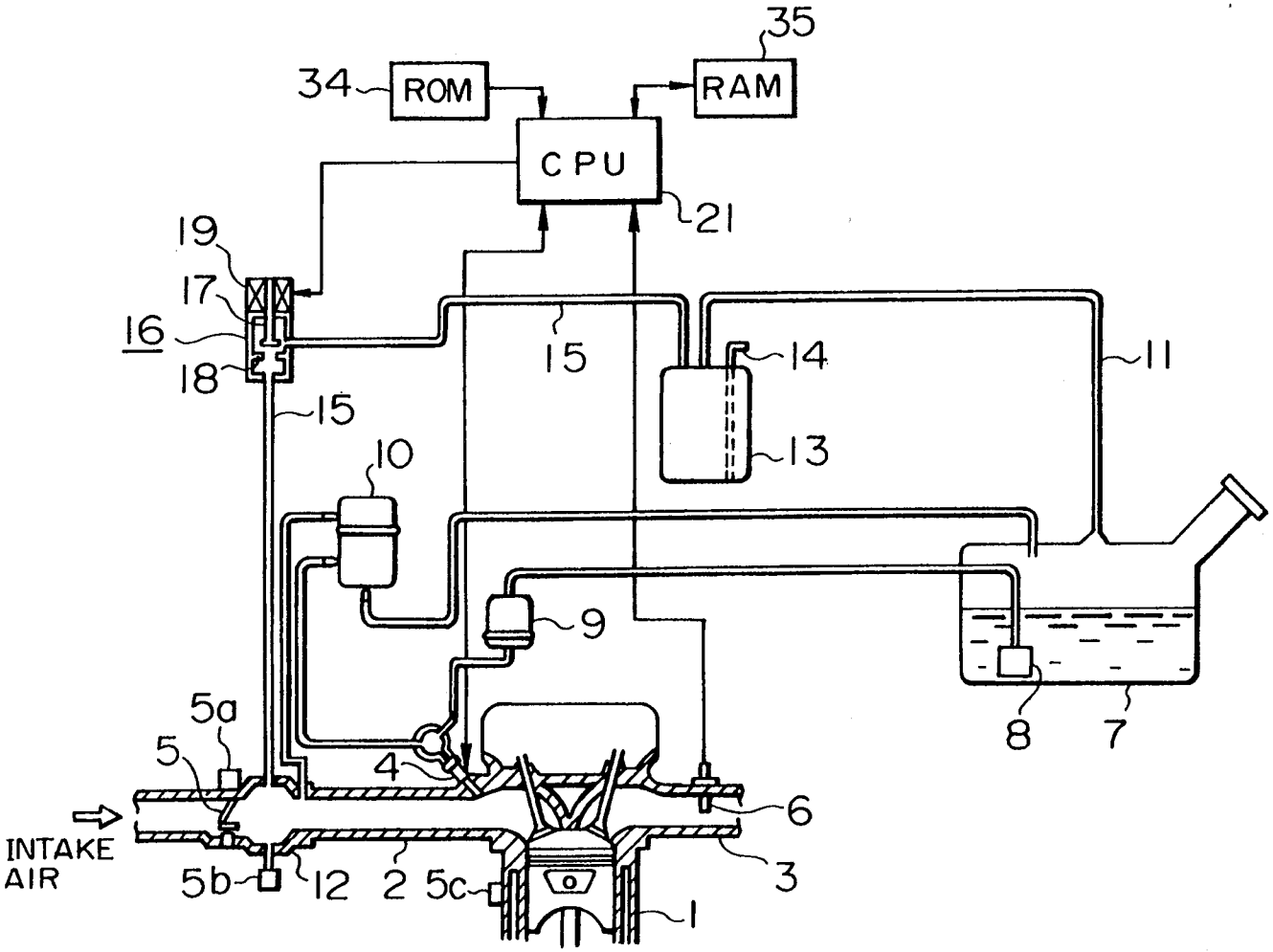
FIG. 1 is a schematic diagram illustrating the whole configuration of an embodiment of the present invention.

Referring now to FIG. 1, a multi-cylinder engine 1 is mounted in a vehicle and an intake pipe 2 and an exhaust pipe 3 are connected to the engine 1. An electromagnetic injector 4 is disposed in the intake pipe 2 and a throttle valve 5 is disposed upstream thereof. An oxygen sensor 6 is disposed as air-fuel detection means in the exhaust pipe 3 and produces a voltage signal in accordance with a concentration of oxygen in the exhaust gas.

A fuel supply system for supplying fuel to the injector 4 includes a fuel tank 7, a fuel pump 8, a fuel filter 9 and a pressure regulating valve 10. Fuel in the fuel tank 7 is fed to the injector 4 of each cylinder through the fuel filter 9 by the fuel pump 8 while the fuel supplied to the injector 4 is regulated to a predetermined pressure by the pressure regulating valve 10.

A purge pipe 11 extending from the upper portion of the fuel tank 7 communicates with a surge tank 12 of the intake pipe 2 and a canister 13 containing active carbon as absorption material for absorbing evaporated fuel produced in the fuel tank is disposed on the way of the purge pipe 11. An atmosphere opening 14 for introducing the outside air is formed in the canister 13. The surge tank 12 is used as a discharge path 15 for the purge pipe 11 as compared with the canister 13 and a variable flow rate solenoid valve 16 (hereinafter referred to as a purge solenoid valve) is disposed on the way of the discharge path 15. The purge solenoid valve 16 is always urged by a spring (not shown) so that a valve body 17 closes a seat portion 18, and when a coil 19 is excited, the valve body 17 opens the seat portion 18. Accordingly, the discharge path 15 is closed by extinction of the excitation of the coil 19 of the purge solenoid valve 16 and is opened by the excitation of the coil 19. The opening of the purge solenoid valve 16 is regulated by means of a CPU 21 described later by the duty ratio control based on the pulse width modulation.

Figure 2:
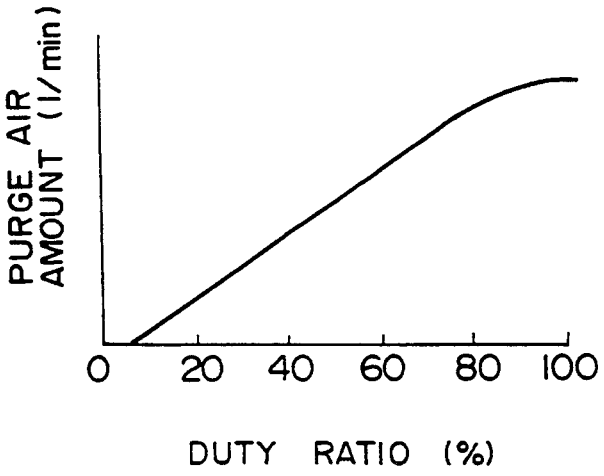
FIG. 2 is a characteristic diagram of a purge solenoid valve in the embodiment.

Accordingly, by supplying a control signal from the CPU 21 to the purge solenoid valve 16 so that the canister 13 communicates with the intake pipe 2 of the engine 1, fresh air Qa in the atmosphere is introduced into the canister to thereby ventilate the canister 13 and the fresh air is fed into the cylinder through the intake pipe 2 of the engine 1, so that the purging of the canister is performed to recover the absorption function of the canister 13. An introduced quantity Qp (l/min) of the fresh air Qa at this time is regulated by changing the duty ratio of a pulse signal supplied to the purge solenoid valve 16 from the CPU 21. FIG. 2 is a characteristic diagram of the purge quantity at this time and represents a relation of the purge quantity and the duty ratio of the purge solenoid valve 16 on condition that a negative pressure within the intake pipe is constant. It is apparent from FIG. 2 that the purge quantity, that is, an amount of air sucked into the engine 1 through the canister 13 is increased as the duty ratio of the purge solenoid valve is increased from 0%.

The CPU 21 is supplied with a throttle opening signal from a throttle sensor 5*a* for detecting an opening of the throttle valve 5, a rotational number signal of the engine from a rotational number sensor (not shown) for detecting the rotational number of the engine 1, an intake air pressure signal (which may be an intake air amount signal from an intake air amount sensor) from an intake air pressure sensor 5*b* for detecting a pressure of intake air passing through the throttle valve 5, a cooling water temperature signal from a water temperature sensor 5*c* for detecting a temperature of the cooling water of the engine, and an intake air temperature signal from an intake air temperature sensor (not shown) for detecting an intake air temperature.

Further, the CPU 21 is supplied with a signal (voltage signal) from the oxygen sensor 6 to judge whether an air-fuel mixture is rich or lean. The CPU 21 changes (skips) a feedback correction coefficient stepwise so as to increase or decrease the fuel injection quantity when the air-fuel mixture is changed from a rich state to a lean state and from a lean state to a rich state and the CPU 21 increases or decreases the feedback correction coefficient gradually when the fuel injection quantity is rich or lean. The feedback control is not made when a cooling water temperature of the engine is low and when the engine is moved under heavy load and high rotation. Further, the CPU 21 calculates a basic injection time on the basis of the rotational number of the engine and the intake air pressure and makes correction by the feedback correction coefficient with respect to the basic injection time to calculate a final injection time TAU, so that injection of fuel is performed at a predetermined injection timing by the injector 4.

An ROM 34 stores programs and maps for controlling operation of the whole engine. An RAM 35 stores various data, such as, for example, an opening of the throttle valve 5 and detected data such as a rotational number of the engine temporarily. Thus, the CPU 21 controls operation of the engine on the basis of the programs stored in the ROM 34.

The system performs feedback control of an air-fuel ratio, purge ratio control, detection of an evaporated fuel concentration, fuel injection quantity control, air-fuel ratio learning control and purge solenoid valve control.

Operation of the embodiment is now described for each control.

FEEDBACK CONTROL OF AIR-FUEL RATIO

Figure 3:
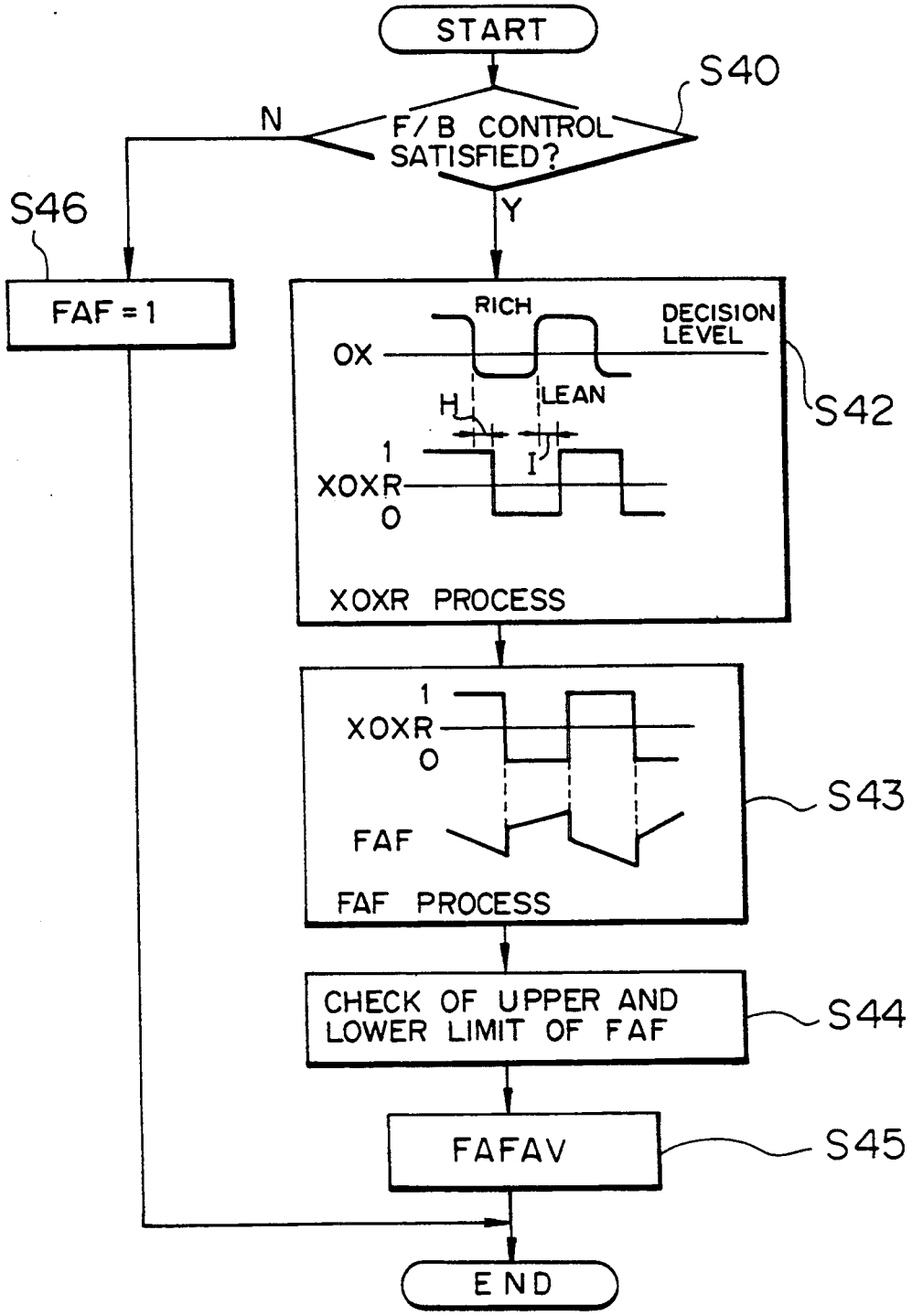
FIG. 3 is a flow chart showing feedback control of an air-fuel ratio in the embodiment.

Referring now to FIG. 3, the feedback control of an air-fuel ratio is described. The feedback control of the air-fuel ratio is performed in a base routine of the CPU 21 at intervals of about 4 ms.

First of all, in step S40, whether the feedback (F/B) control is possible or not is judged. The F/B control is performed when all of the following conditions are satisfied.

(1) no starting time, (2) fuel is not cut, (3) cooling water temperature (THW)≧40° C., (4) TAU>$TAU_{min0}$, and (5) oxygen sensor is active.

When all of the conditions are satisfied, the process proceeds to step S42 in which an output of the oxygen sensor is compared with a predetermined decision level and an air-fuel ratio flag XOXR is operated with a delay time (H or I msec). For example, when XOXR=1, the air-fuel ratio is controlled to be rich, and when XOXR=0, the air-fuel ratio is controlled to be lean. Then, the process proceeds to step S43 in which a value of FAF is operated on the basis of the XOXR. That is, when the XOXR is changed from 0 to 1 (0→1) or from 1 to 0 (1→0), the value of FAF is changed by a predetermined value discontinuously and when the XOXR is 1 or 0, integration control of the FAF value is made. Then, the process proceeds to step S44 and after the upper and lower limits of the FAF value have been checked, the process proceeds to step S45 in which an averaging process is made for each change of the FAF value or at intervals of a predetermined time on the basis of the decided FAF value to calculate an average value FAFAV. In step S40, when the F/B control is not possible, the process proceeds to step S46 in which the FAF value is set to 1.0.

PURGE RATIO CONTROL

Figure 4:
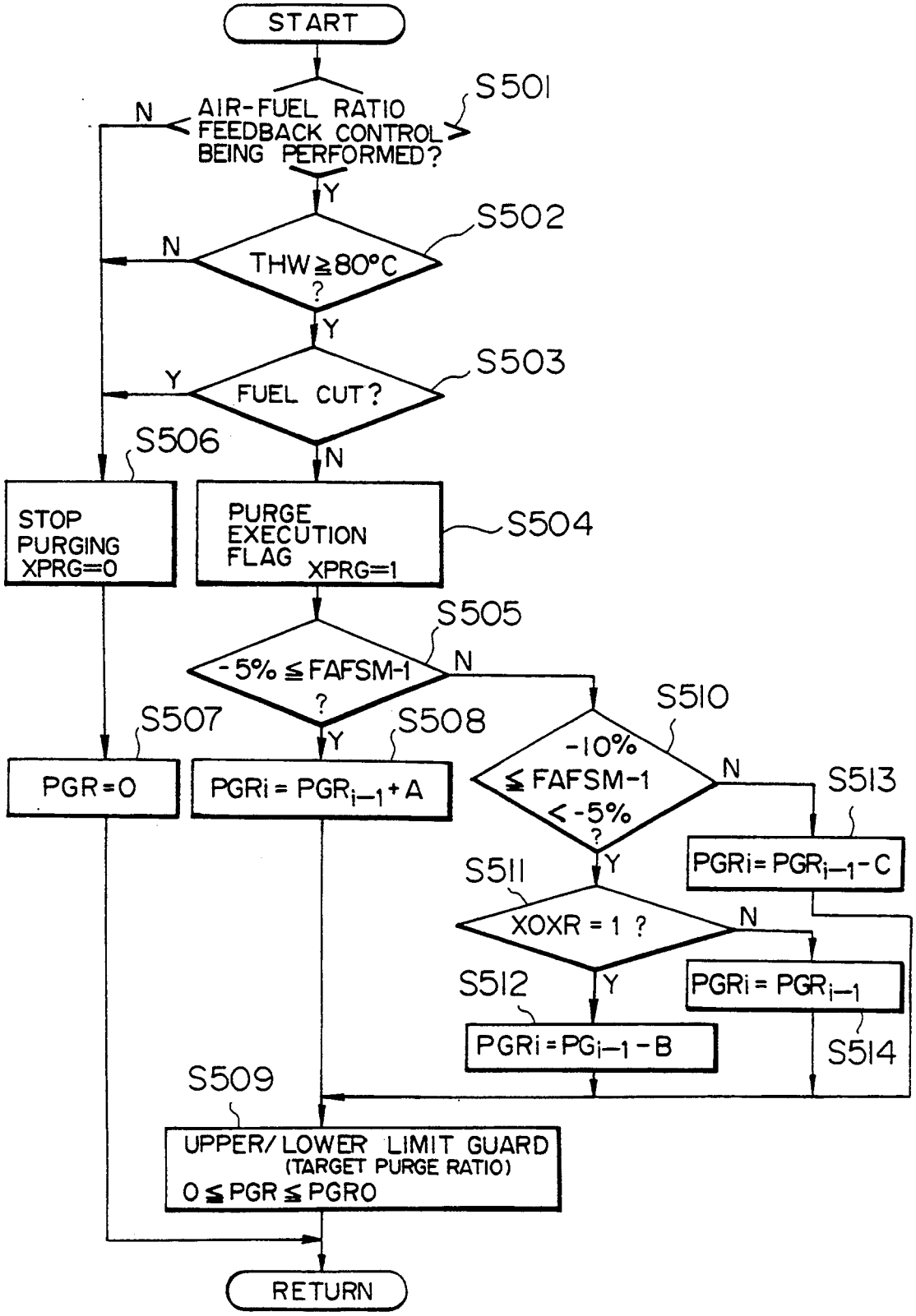
FIG. 4 is a flow chart showing purge ratio control in the embodiment.

A main routine of the purge ratio control is shown in FIG. 4. This routine is also performed in the base routine of the CPU 21 at intervals of about 4 ms.

In step S501, whether the air-fuel ratio feedback control is being performed or not is judged. When it is being performed, whether the cooling water temperature (THW) is equal to or higher than 80° C. (≧80° C.) or not is judged in next step S502. When the cooling water temperature (THW) is equal to or higher than 80° C. (≧80° C.), whether fuel is cut or not is judged in next step S503. When it is judged that fuel is not cut, the process proceeds to step S504 and after a purge execution flag XPRG for executing the purge ratio control has been set to 1, the process proceeds to next step S505. Further, in steps S501, S502 and S503, when conditions for the purge ratio execution are not satisfied, the process proceeds to step S506 and after the purge execution flag XPRG has been set to 0, the process proceeds to step S507 in which the purge ratio is set to 0.

In step S505, whether an FAFSM value obtained by averaging the FAF value by a predetermined constant (for example, 1/128) which is sufficiently larger than the FAFAV of FIG. 3 is within −5% with respect to a reference value 1.0 or not is judged. When it is within −5%, the process proceeds to step S508 in which a predetermined value A (for example, 0.02%) is added to a last purge ratio $PGR_{i-1}$ to calculate a purge rate $PGR_i$ for this time. Then, the process proceeds to step S509. Further, in step S505, when it is judged that the FAFSM value is not within −5% with respect to the reference value 1.0, the process proceeds to step S510 in which whether the FAFSM value is within the range of −10%≦FAFSM−1<−5% with respect to the reference value 1.0 or not is judged. When the FAFSM value is within the range of −10%≦FAFSM−1<−5%, the process proceeds to step S511 in which whether the air-fuel flag XOXR is 1 or not is judged and when the flag XOXR is 1, the process proceeds to step S512 in which a predetermined value B (for example, 0.01%) is subtracted from the last purge ratio $PGR_{i-1}$ to calculate a purge rate $PGR_i$ for this time. Then, the process proceeds to step S509.

In step S510, when it is judged that the FAFSM value is not within the range of −10%≦FAFSM−1<−5%, the process proceeds to step S513 in which a predetermined value C (for example, 0.02%) is subtracted from the last purge ratio $PGR_{i-1}$ to calculate the purge ratio $PGR_i$ for this time. Then, the process proceeds to step S 509. Further, in step S511, when it is judged that the XOXR is not 1, the process proceeds to step S514 in which the last purge ratio $PGR_{i-1}$ is set to be the $PGR_i$ as it is, and then the process proceeds to step S509. In step S509, guarding operation for upper limit and lower limit of the PGR is performed. The lower limit value is 0 and the upper limit value is a predetermined value or a table value determined previously by operation conditions of the engine.

In accordance to the purge ratio control routine shown in FIG. 4, when the FAFSM value is within −5% with respect to the reference value 1.0, the purge ratio is gradually increased by 0.02% every predetermined time from the beginning of the purging. When the FAFSM value is within the range of $-10\% \leqq FAFSM-1 < -5\%$ with respect to the reference value 1.0 and the XOXR is not 1, increase of the purge ratio is stopped to hold the purge ratio. When the FAFSM value is within the range of $-10\% \leqq FAFSM-1 < -5\%$ with respect to the reference value 1.0 and the XOXR is 1, increase of the purge is stopped and the purge ratio is gradually reduced by 0.01% every predetermined time. When the FAFSM value is outside of the range of $-10\% \leqq FAFSM-1 < -5\%$ with respect to the reference value 1.0, increase of the purge ratio is stopped and the purge ratio is gradually reduced by 0.02% every predetermined time.

EVAPORATED FUEL CONCENTRATION DETECTION

Figure 5:
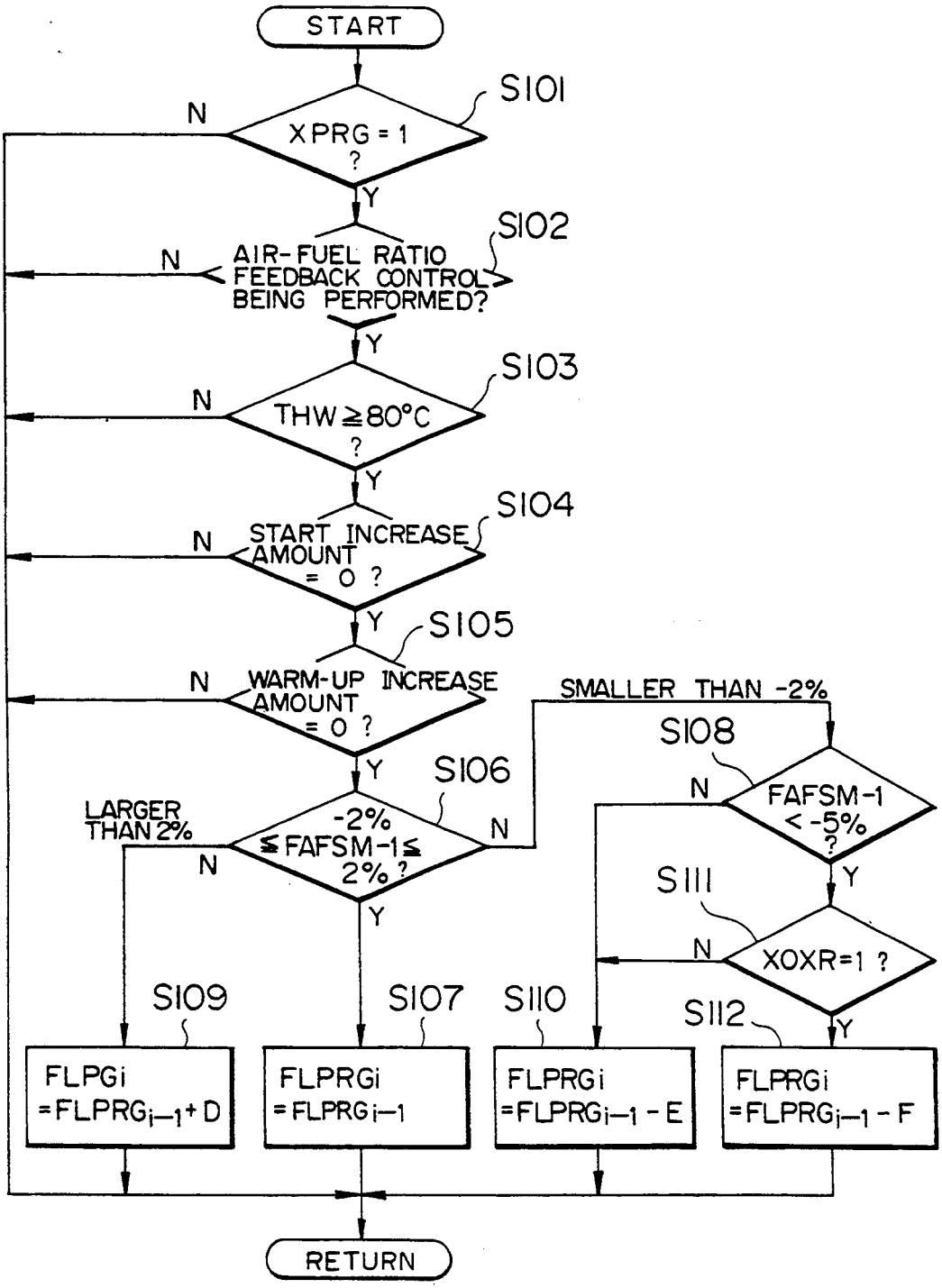
FIG. 5 is a flow chart showing detection of the concentration of the evaporated fuel in the embodiment.

A main routine of the evaporated fuel concentration detection executed in the base routine of the CPU 21 at intervals of about 4 ms is shown in FIG. 5. First of all, in step S101, when the purging control has been performed and the purge execution flag XPRG is 1, the process proceeds to step S102, while when the flag XPRG is 0 and the purging control has not been performed, the process is finished as it is. In step S102, whether the air-fuel ratio feedback control is being performed or not is judged. When the air-fuel ratio feedback control is being performed, the process proceeds to step S103, while the air-fuel ratio feedback control is not being performed, the process is finished as it is.

In step S103, whether the cooling water temperature (THW) is equal to or higher than 80° C. (≧80° C.) or not is judged. When the cooling water temperature is equal to or higher than 80° C., the process proceeds to step S104, while when the cooling water temperature is not equal to or higher than 80° C., the process is finished as it is. In step S104, when a start increase amount of fuel injection is 0 or not is judged. When the amount is 0, the process proceeds to step S105, while the amount is not 0, the process is finished as it is. In step S105, when a warm-up increase amount of fuel injection is 0 or not is judged. When the amount is 0, the process proceeds to step S106, while when the amount is not 0, the process is finished as it is.

In step S106, whether the FAFSM value is within the range of $-2\% \leqq FAFSM-1 < 2\%$ with respect to the reference value 1.0 or not is judged. When the FAFSM value is within the range of $-2\% \leqq FAFSM-1 < 2\%$, the process proceeds to step S107 and after the last evaporated fuel concentration $FLPRG_{i-1}$ has been set to be the $FLPRG_i$ for this time, the process is finished. Further, in step S106, when it is judged that the FAFSM value is larger than 2% with respect to the reference value 1.0, the process proceeds to step S108 and after a predetermined value D (for example, 0.02%) has been added to the last value $FLPRG_{i-1}$ of the evaporated fuel concentration to calculate the evaporated fuel concentration $FLPRG_i$ for this time, the process is finished.

In step S106, when it is judged that the FAFSM value is smaller than −2% with respect to the reference value 1.0, the process proceeds to step S109 and whether the FAFSM value is smaller than −5% with respect to the reference value 1.0 or not is judged. When it is judged that the FAFSM value is within −5% with respect to the reference value 1.0, the process proceeds to step S110 and after the a predetermined value E (for example, 0.02%) has been subtracted from the last evaporated fuel concentration $FLPRG_{i-1}$ to calculate the evaporated fuel concentration $FLPRG_i$ for this time, the process is finished. Further, in step S109, when it is judged that the FAFSM value is smaller than −5% with respect to the reference value 1.0, the process proceeds to step S111 and whether the air-fuel ratio flag XOXR is 1 or not is judged. When the flag XOXR is 1, the process proceeds to step S112 and after a predetermined value F (for example, 0.04%) has been subtracted from the last evaporated fuel concentration $FLPRG_{i-1}$ to calculate the evaporated fuel concentration $FLPRG_i$ for this time, the process is finished. In step S111, when the air-fuel ratio flag XOXR is not 1, the process proceeds to step S110.

In accordance with the evaporated fuel concentration detection routine shown in FIG. 5, the evaporated fuel concentration FLPRG is 1 when the evaporated fuel value in the discharge path 15 is 0 (air is 100%) and is set to a value smaller than 1 as the evaporated fuel concentration in the discharge path 15 is increased. Further, when the FAFSM value is within −5% with respect to the reference value 1.0 and the XOXR is not 1 even if the FAFSM value is smaller than −5% with respect to the reference value 1.0, the evaporated fuel concentration FLPRG is reduced by 0.02% every predetermined time, whereas when the FAFSM value is smaller than −5% with respect to the reference value 1.0 and the XOXR is 1, the evaporated fuel concentration FLPRG is reduced by 0.04% every predetermined time.

FUEL INJECTION QUANTITY CONTROL

Figure 6:
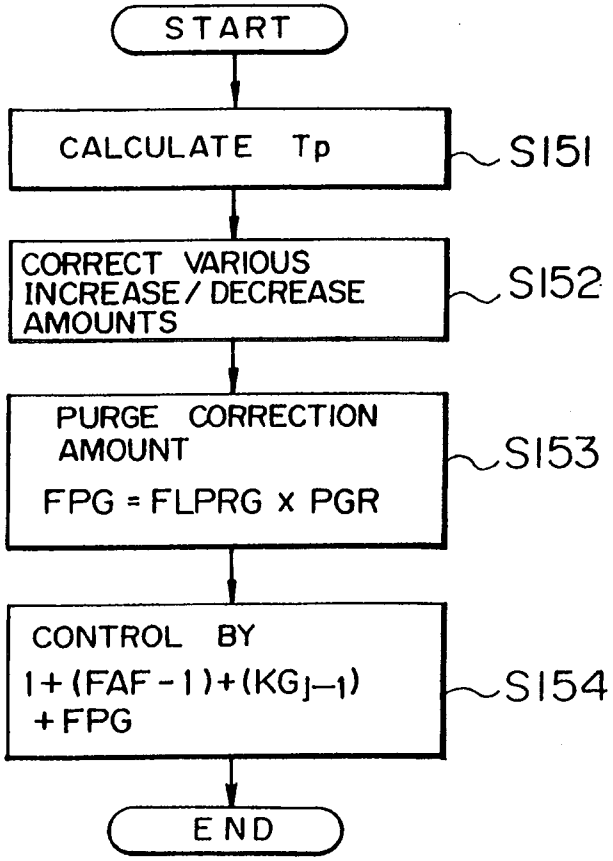
FIG. 6 is a flow chart showing control of the injection quantity of fuel in the embodiment.

The fuel injection quantity control performed in the base routine of the CPU 21 at intervals of about 4 ms is shown in FIG. 6.

In step S151, a basic fuel injection quantity (TP) is calculated from a rotational number of the engine and a load (for example, pressure in the intake pipe) on the basis of data stored in the ROM 34 as a map, and in next step S152 various basic corrections (cooling water temperature, after start, intake air temperature, etc.) are performed. In step S153, the evaporated fuel concentration FLPRG is multiplied by the purge ratio PGR to calculate a purge correction coefficient FPG and in next step S154 the FAF, the FPG and a learning value (KGj) of the air-fuel ratio provided in each engine operation area are calculated as correction coefficients to make a following equation as a control factror of the fuel injection quantity TAU.

$1+(FAF-1)+(KGj-1)+FPG$

PURGE SOLENOID VALVE CONTROL

Figure 7:
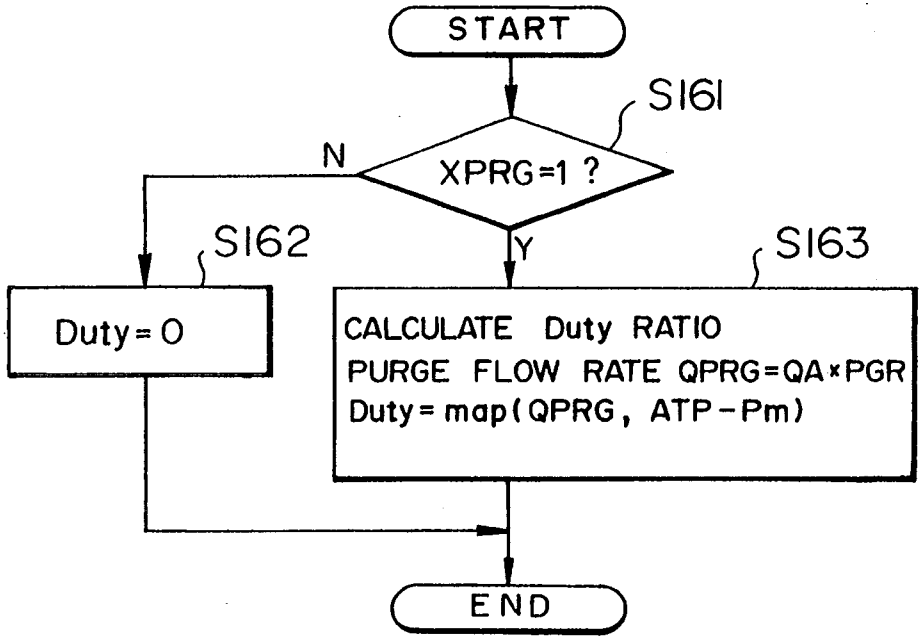
FIG. 7 is a flow chart showing control of a purge solenoid valve in the embodiment.

The purge solenoid valve control routine performed by the CPU 21 in response to a time interrupt at intervals of 100 ms is shown in FIG. 7. In step S161, when the purge execution flag XPRG is 0, the process proceeds to step S162 and the duty ratio of the purge solenoid valve 16 is set to be 0. Otherwise, the process proceeds to step S163 and the duty ratio of the purge solenoid valve 16 is calculated.

The fact that the basic fuel injection quantity (TP) and the intake air quantity QA are correlative to each other is utilized to calculate the intake air quantity QA previously stored in the ROM 34 from the basic fuel injection quantity (TP) calculated in step S151 of FIG. 6. The intake air quantity QA is multiplied by the purge ratio PGR calculated in FIG. 4 to calculate a purge flow rate QPRG. Since the duty ratio of the purge solenoid valve 16 is determined by the purge flow rate QPRG and a value obtained by subtracting an intake pipe pressure Pm from the atmospheric pressure ATP, the duty ratio of the purge solenoid valve 16 is calculated on the basis of the data previously stored as a map in the ROM 34 while the purge flow rate QPRG and the value obtained by subtracting the intake pipe pressure Pm from the atmospheric pressure ATP are used as inputs.

AIR-FUEL RATIO LEARNING CONTROL

Figure 8:
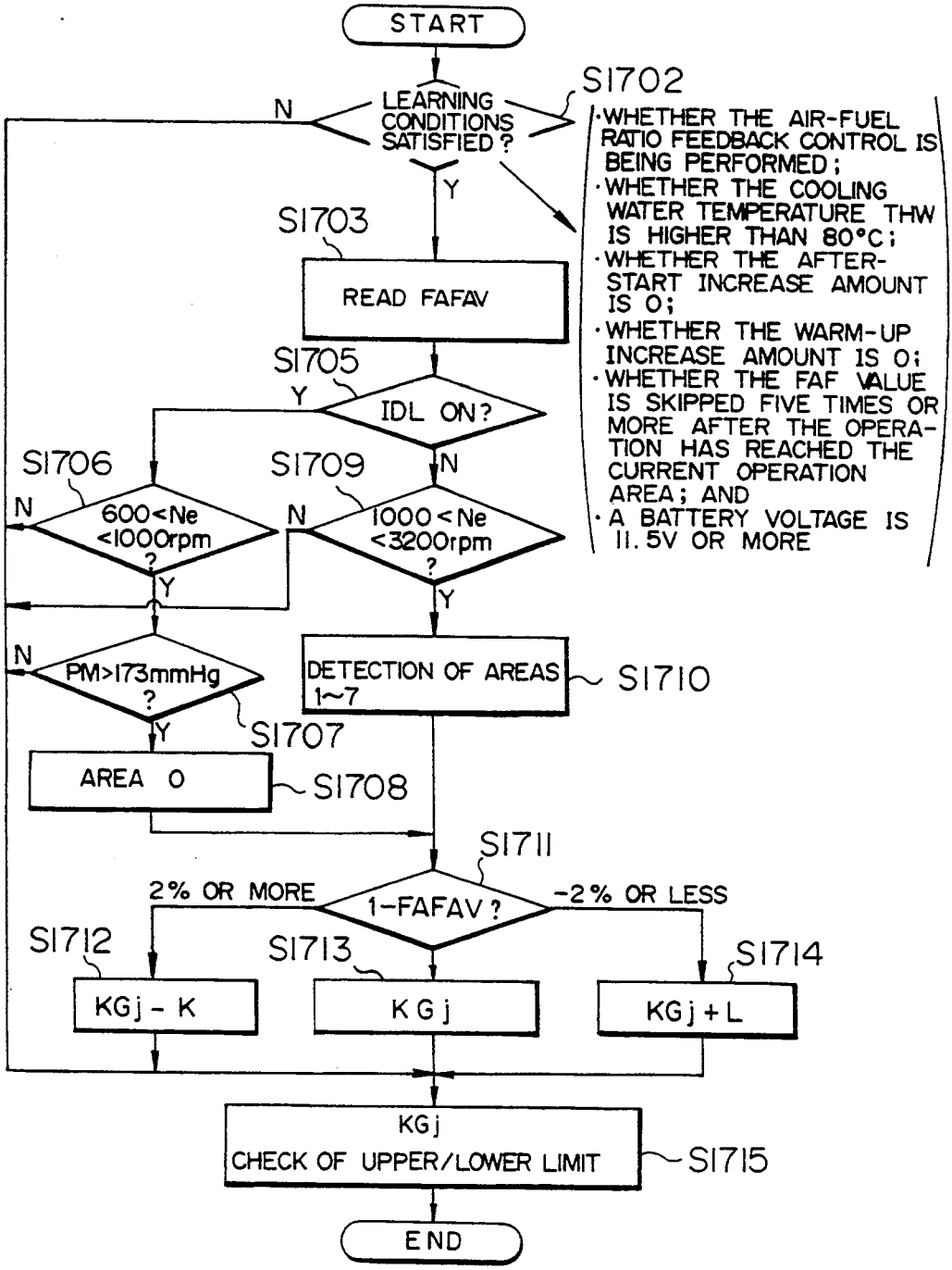
FIG. 8 is a flow chart showing learning control of the air-fuel ratio in the embodiment.

The air-fuel ratio learning control routine performed each time the FAF value is skipped is shown in FIG. 8. In step S1702, judgment as to whether all of learning conditions including whether the air-fuel ratio feedback control is being performed, whether the cooling water temperature THW is higher than 80° C., whether the after-start increase amount is 0, whether the warm-up increase amount is 0, whether the FAF value is skipped five times or more after the operation has reached the current operation area, and whether a battery voltage is 11.5 V or more are satisfied is made. When even one of the learning conditions is not satisfied, the process is finished as it is, while when all of the learning conditions are satisfied, the FAFAV value is read in next step S1703 and judgment as to whether the engine is idle or not is made in step S1705. Thus, the process is divided into the process in the idle $KG_0$ (step S1708) and the process in the running (step S1710) in accordance with the judgment result as to whether the engine is idle or not in step S1705. The process in the running is made by dividing into a predetermined number (for example, 7) of areas $KG_1$ to $KG_7$ in accordance with a load (for example, pressure in the intake pipe). The learning value is updated only when the rotational number of the engine is within a predetermined rotational number (600 to 1,000 rpm for the idle and 1,000 to 3,200 rpm for the running) in steps S1706 and S1709, respectively. Further, in the idle, when the intake pipe pressure PM is higher than 173 mmHg in step S1707, the learning value is updated.

The update method of the learning values $KG_0$ to $KG_7$ for the areas is made by increasing or decreasing the learning values $KG_0$ to $KG_7$ for the areas by a predetermined value (K% or L%) when a difference of the FAFAV and the reference value 1.0 is larger than a predetermined value (for example, 2%) (step S1711 to S1714). Finally, the upper and lower limit of KGj is checked (step S1715). The upper limit of KGj is set to, for example, 1.2 and the lower limit is set to, for example, 0.8. The upper and lower limits can be set in each operation area of the engine. It is a matter of course that the learning values $KG_0$ to $KG_7$ for the areas are stored in the RAM 35 (learning value storing means) backed up by a battery so that the stored values are held even after a key switch is turned off.

Figure 9:
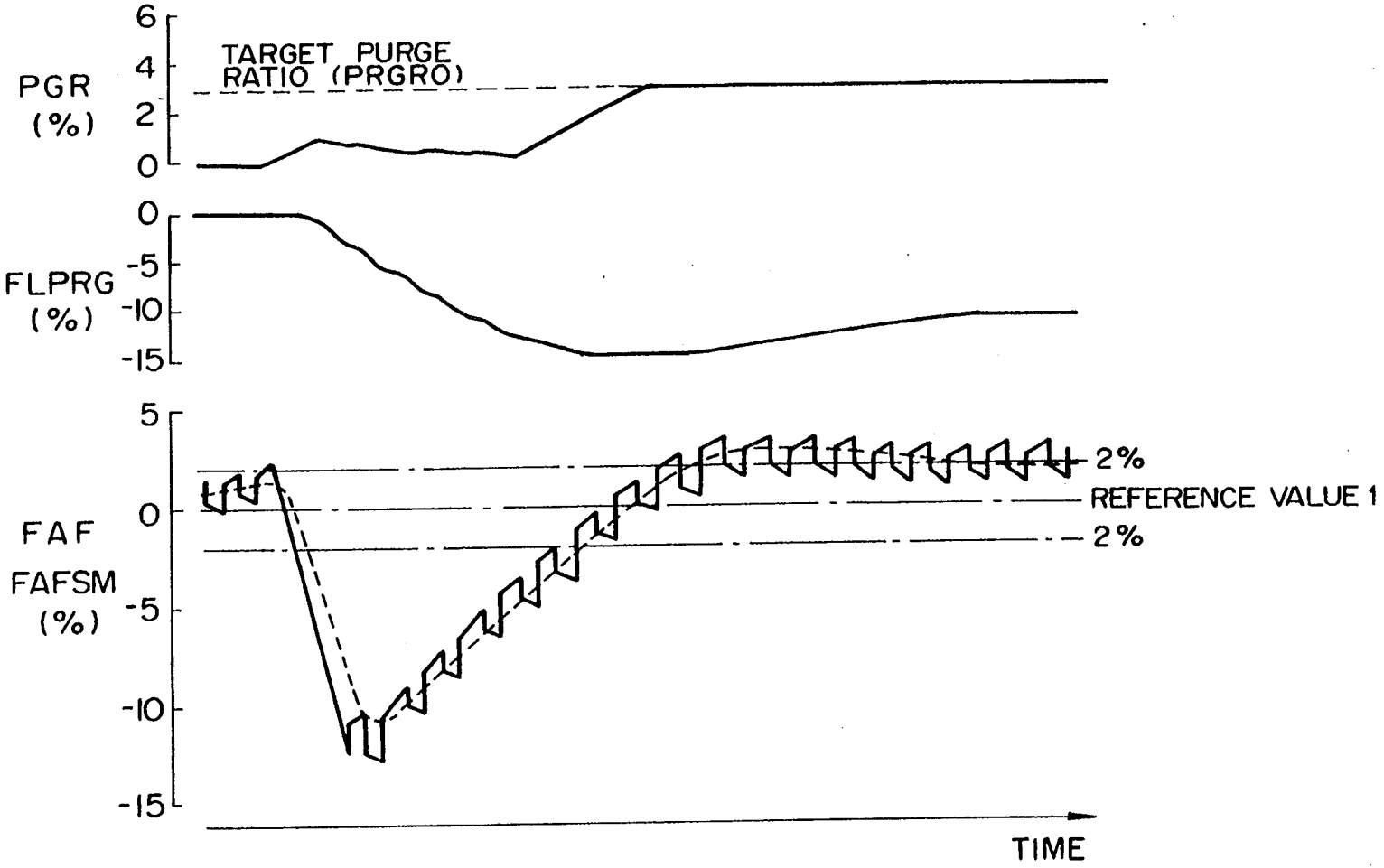
FIGS. 9A–C are timing chart showing waveforms of various portions in the embodiment.

A timing chart for the embodiment described above is shown in FIG. 9. In FIG. 9, (A) represents the purge ratio PGR, (B) a deviation in % of the detected evaporated fuel concentration FLPRG from the reference value 1.0, and (C) deviations in % of the FAF value and the FAFSM value from the reference value 1.0.

In the embodiment, the switching control as to whether the purge ratio being increased is held or reduced is made on the basis of the FAFSM value in step S510 of FIG. 4 and in view of the condition of the flag XOXR in step S511, while the control as to whether the purge ratio being increased is held or reduced is made on the basis of only the FAFSM value or in view of only the condition of the flag XOXR.

In the embodiment, the switching control for the update value of the FLPRG is made on the basis of the FAFSM value in step S109 of FIG. 5 and in view of the condition of the flag XOXR in step S111, while the switching control for the update value of the FLPRG is made on the basis of only the FAFSM value or in view of only the condition of the flag XOXR.

As described above, according to the present invention, the concentration of the evaporated fuel is detected by the concentration detection means on the basis of the air-fuel ratio feedback value by the air-fuel feedback means and the fuel amount is corrected by the purge responsive fuel amount correction means so that the air-fuel ratio is equal to the predetermined value in accordance with the evaporated fuel concentration detected by the concentration detection means and the purge ratio by the purge ratio control means. When it is judged that the air-fuel ratio is excessive on the basis of at least one of the output of the air-fuel ratio detection means and the air-fuel ratio feedback value while the purging operation is executed by means of the flow rate control valve, the update concentration value of the concentration detection means is made larger than the usual value by the air-fuel ratio responsive concentration update means or When it is judged that the air-fuel ratio is excessive on the basis of at least one of the output of the air-fuel ratio detection means and the air-fuel ratio feedback value while the purging operation is executed by means of the flow rate control valve, increase of the purge ratio by the flow rate control valve is suppressed by the air-fuel ratio responsive purge ratio suppression means, and accordingly it is advantageous that the excessive air-fuel ratio in the beginning of the purging can be suppressed.

It is claimed:

1. An air-fuel ratio controller of an internal combustion engine which stores evaporated fuel produced within a fuel tank in a canister and discharges the evaporated fuel stored in the canister into an air intake side of the internal combustion engine through a discharge path together with air, comprising:

air-fuel ratio detection means for detecting an air-fuel ratio of the internal combustion engine;

air-fuel ratio feedback means for feedback controlling an air-fuel ratio of an air-fuel mixture supplied to the internal combustion engine in accordance with the air-fuel ratio detected by said air-fuel detection means;

a flow rate control valve for changing a purge ratio of air containing the evaporated fuel discharged into the air intake side of the internal combustion engine through the discharge path from the canister;

purge ratio control means for controlling the purge ratio by said flow rate control valve in accordance with a condition of the engine;

concentration detection means for detecting a concentration of the evaporated fuel on the basis of the feedback value of the air-fuel ratio by said feedback means;

purge responsive fuel amount correction means for correcting a fuel amount so that the air-fuel ratio is equal to a predetermined value in accordance with the concentration of the evaporated fuel detected by said concentration detection means and the purge ratio controlled by said purge ratio control means; and air-fuel ratio responsive concentration updating means for increasing an update amount of the concentration of said concentration detection means as compared with a usual amount when it is judged that the air-fuel ratio is excessive on the basis of at least one of an output of said air-fuel ratio detection means and the feedback value of the air-fuel ratio during the purging operation by said flow rate control valve.

2. An air-fuel ratio controller of an internal combustion engine which stores evaporated fuel produced within a fuel tank in a canister and discharges the evaporated fuel stored in the canister into an air intake side of the internal combustion engine through a discharge path together with air, comprising:

air-fuel ratio detection means for detecting an air-fuel ratio of the internal combustion engine;

air-fuel ratio feedback means for feedback controlling an air-fuel ratio of an air-fuel mixture supplied to the internal combustion engine in accordance with the air-fuel ratio detected by said air-fuel detection means;

a flow rate control valve for changing a purge ratio of air containing the evaporated fuel discharged into the air intake side of the internal combustion engine through the discharge path from the canister;

purge ratio control means for controlling the purge ratio by said flow rate control valve in accordance with a condition of the engine and increasing the purge ratio gradually in the beginning of the purging of said flow rate control valve; and air-fuel ratio responsive purge ratio suppressing means for suppressing increase of the purge ratio by said flow rate control valve when it is judged that the air-fuel ratio is excessive on the basis of at least one of an output of said air-fuel ratio detection means and the feedback value of the air-fuel ratio during the purging operation by said flow rate control valve.

3. An air-fuel ratio controller of an internal combustion engine which stores evaporated fuel produced within a fuel tank in a canister and discharges the evaporated fuel stored in the canister into an air intake side of the internal combustion engine through a discharge path together with air, comprising:

air-fuel ratio detection means for detecting an air-fuel ratio of the internal combustion engine;

air-fuel ratio feedback means for feedback controlling an air-fuel ratio of an air-fuel mixture supplied to the internal combustion engine in accordance with the air-fuel ratio detected by said air-fuel detection means;

a flow rate control valve for changing a purge ratio of air containing the evaporated fuel discharged into the air intake side of the internal combustion engine through the discharge path from the canister;

purge ratio control means for controlling the purge ratio by said flow rate control valve in accordance with a condition of the engine and increasing the purge ratio gradually in the beginning of the purging of said flow rate control valve;

concentration detection means for detecting a concentration of the evaporated fuel on the basis of the feedback value of the air-fuel ratio by said feedback means;

purge responsive fuel amount correction means for correcting a fuel amount so that the air-fuel ratio is equal to a predetermined value in accordance with the concentration of the evaporated fuel detected by said concentration detection means and the purge ratio controlled by said purge ratio control means;

air-fuel ratio responsive concentration updating means for increasing an update amount of the concentration of said concentration detection means as compared with a usual amount when it is judged that the air-fuel ratio is excessive on the basis of at least one of an output of said air-fuel ratio detection means and the feedback value of the air-fuel ratio during the purging operation by said flow rate control valve; and air-fuel ratio responsive purge ratio suppressing means for suppressing increase of the purge ratio by said flow rate control valve when it is judged that the air-fuel ratio is excessive on the basis of at least one of an output of said air-fuel ratio detection means and the feedback value of the air-fuel ratio during the purging operation by said flow rate control valve.

* * * * *